US006478639B1

(12) United States Patent
Covell, III

(10) Patent No.: US 6,478,639 B1
(45) Date of Patent: Nov. 12, 2002

(54) WATERCRAFT HAVING JET PROPULSION AND ELECTRIC OUTDRIVE

(76) Inventor: Edward H. Covell, III, 919 Riverside Dr., Salisbury, MD (US) 21801

( * ) Notice: Subject to any disclaimer, the term of this patent is extended or adjusted under 35 U.S.C. 154(b) by 0 days.

(21) Appl. No.: 09/900,974

(22) Filed: Jul. 10, 2001

Related U.S. Application Data

(60) Provisional application No. 60/218,667, filed on Jul. 17, 2000.

(51) Int. Cl.[7] ..... B60L 11/02

(52) U.S. Cl. ..... 440/6; 440/38; 114/347

(58) Field of Search ..... 114/56.1, 151, 114/347; 440/38, 71, 72, 73, 6

(56) References Cited

U.S. PATENT DOCUMENTS

| | | | | | |
|---|---|---|---|---|---|
| 804,497 | A | * | 11/1905 | Palmer | 440/71 |
| 2,570,595 | A | | 10/1951 | Romero | 114/56.1 |
| 3,580,212 | A | * | 5/1971 | Fortson | 440/6 |
| 3,619,632 | A | * | 11/1971 | Labombarde | 114/39.21 |
| 3,797,447 | A | | 3/1974 | Stubblefield | 114/151 |
| 3,865,067 | A | | 2/1975 | Archer | 114/151 |
| 4,194,458 | A | * | 3/1980 | Messing | 114/363 |
| 4,311,470 | A | * | 1/1982 | Blanchard | 440/6 |
| 4,681,056 | A | * | 7/1987 | Friedle et al. | 114/146 |
| 4,898,552 | A | * | 2/1990 | Cochran | 440/71 |
| 4,911,664 | A | * | 3/1990 | Gremillion | 440/73 |
| 5,481,997 | A | | 1/1996 | Arndt | 114/347 |
| 5,662,505 | A | | 9/1997 | Spriggs | 114/347 |
| 5,765,499 | A | | 6/1998 | McKenzie | 114/347 |
| 5,769,674 | A | * | 6/1998 | Stallman | 440/38 |
| 5,937,785 | A | | 8/1999 | Murray, III | 114/347 |
| 5,993,274 | A | * | 11/1999 | Rising et al. | 440/71 |

* cited by examiner

*Primary Examiner*—S. Joseph Morano
*Assistant Examiner*—Lars A. Olson
(74) *Attorney, Agent, or Firm*—Dykema Gossett PLLC

(57) ABSTRACT

A watercraft having a combination of a canoe and a power boat style hull with a propulsion mechanism and an electric outdrive mechanism. The propulsion mechanism draws water from beneath the watercraft, through a water intake into a pump which pumps the water out through pipes located in wings formed in the hull. The electric outdrive mechanism has a power supply located within the watercraft that supplies power to a motor that turns a propeller attached to the outside of the hull. The motor has a skeg attached thereto to help steer the watercraft.

6 Claims, 2 Drawing Sheets

10
20
70
100
110
112
120
130
140
150
160
170
180
190
200
220
320
330
340
350
360

WATERCRAFT HAVING JET PROPULSION AND ELECTRIC OUTDRIVE

CROSS-REFERENCE TO RELATED APPLICATIONS

This application claims :the benefit of U.S. Provisional Application No. 60/218,667, filed Jul. 17, 2000.

BACKGROUND OF THE INVENTION

This invention relates generally to a watercraft with a unique hull and propulsion design and more particularly to a watercraft having a body that is similar in style and shape to both a canoe and a power boat with both a jet propulsion and an electric outdrive.

Traditionally canoes have a relatively long, narrow body and are manually powered. They are lightweight, easily maneuverable and due to their long, narrow shape, and can easily capsize. Thus, to modify the traditional canoe by adding some form of motorized power supply can create stability problems with the boat, increasing their propensity to roll.

Power boats are primarily powered by either inboard or outboard motors, are not as easily maneuvered as canoes, yet are usually more stable due to their boxy shape and can be driven at high speeds due to their power source. However, power boats generally create a much greater wake in the water compared to a canoe due to their shape and the speed of the boat.

Currently in the art, there are watercraft devices that utilize a jet propulsion system of power such as those shown in U.S. Pat. Nos. 2,570,595 (to Romero), 3,797,447 (to Stubblefield) and 3,865,067 (to Archer). All of the devices show jet propulsion systems having dual propulsion pipes, with the Stubblefield device even showing a y-fitting as will be discussed herein. The Archer and Stubblefield devices are directed to watercraft of traditional power boat shapes while that of Romero is for a modified canoe shape having a flat stem end. However, none of the patents discloses a watercraft having a hull that is tapered at both ends and has both a jet propulsion as well as an electric powered outdrive mechanism combined on the same vessel.

U.S. Patents issued to Arndt (U.S. Pat. No. 5,481,997) and to Murray, HI (U.S. Pat. No. 5,937,785) disclose kayaks having jet powered systems. While the shape of the hulls in both crafts are tapered at both ends, they still lack the combination of both a jet propulsion system in conjunction With an electric powered outdrive system in the same watercraft.

The McKenzie device,. as disclosed in U.S. Pat. No. 5,765,499, is actually directed to a canoe having a hydro-thrust system, that is, both ends of the hull are graduated to a point as in the present invention, however, the system of this watercraft lacks a y-fitting with dual propulsion pipes as well as the uniquely shaped wings on the hull to accommodate such pipes.

The present invention for a watercraft was designed to allow for two separate power sources, is shaped so as to operate in a relatively wakeless manner, yet does not have the propensity to roll and is easily maneuverable like a traditional canoe.

SUMMARY OF THE INVENTION

It is an object of the present invention to provide a watercraft that is powered by both jet propulsion and an electric outdrive.

It is another object of the present invention to provide a watercraft with a hull design that partially protects an electric outdrive from debris in the water, reduces the amount of drag created on the watercraft and lessens the propensity to roll, while being easily maneuverable and creates little wake when operated. at higher speeds.

Other objects, advantages and novel features of the invention will become more apparent from the following detailed description of the invention when taken in conjunction with the accompanying drawings of the watercraft having a combination of a canoe and a power boat style hull with a propulsion mechanism and an electric outdrive mechanism. The propulsion mechanism draws water from beneath the watercraft, through a water intake into a pump which pumps the water out through Jet drives located in the wings formed in the hull. The electric outdrive mechanism has a motor and propeller located outside the hull. There is a skeg attached to the bottom of the motor just prior to the propeller for steering the watercraft.

DETAILED DESCRIPTION OF THE INVENTION

Figures 1, 2, 3, 4:
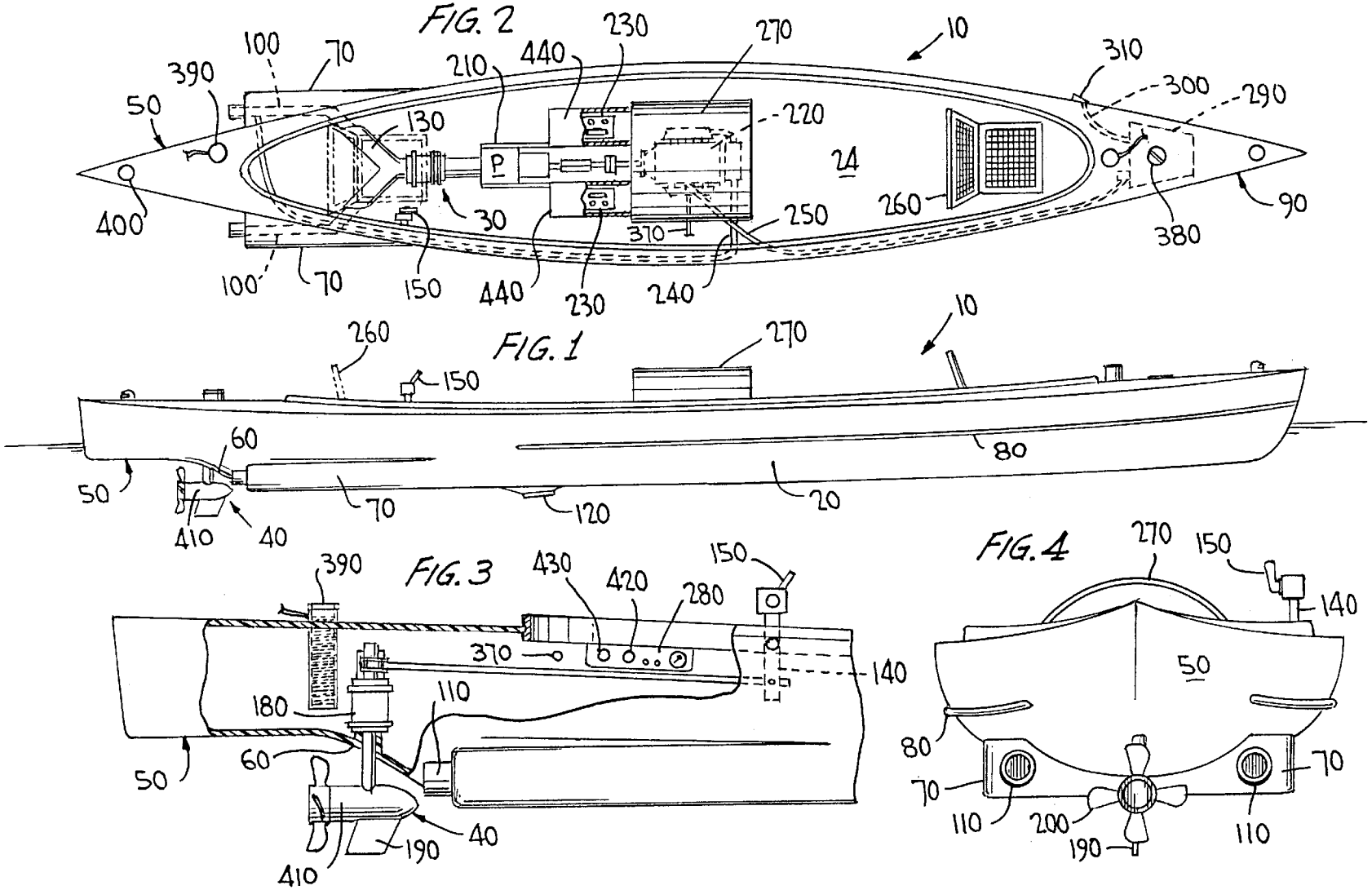
FIG. 1 is a side elevational view of a watercraft having a jet propulsion and electric outdrive.
FIG. 2 is a top plan view of the watercraft of the present invention.
FIG. 3 is a partially broken-away side elevational view of the stern of the watercraft of the present invention.
FIG. 4 is a rear elevational view of the watercraft of the present invention.

As shown in FIGS. 1 and 2, the watercraft generally designated 10 has a hull 20 of some suitable material with a cockpit 24, a jet pump 210 and an electric outdrive 40. The watercraft 10 primarily has the shape of a traditional canoe, a long narrow body that comes to a point on either end. The stem 50 of the hull 20 has a curved portion 60 that provides a transition along the lower edge of the hull so that the stern end 50 of the hull 20 is bouyed slightly higher in the water than the remainder of the hull 20.

Also located at the stem end 50, on opposite sides of the watercraft 10, are two wings 70 that are integrally formed with the hull 20 and house the propulsion pipes 100. These wings 70 help to stabilize the watercraft 10 by displacing water and providing buoyancy to offset the weight of the water that is in the propulsion pipes 100 inside the hull 20. These wings 70 allow the stem 50 more displacement, much like in a conventional power boat design, and help to offset the increased downward thrust that is created on the stem by the rising bow 90 of the boat when the speed is increased.

Extending lengthwise along the hull. 20 and beginning at the bow 90 of the watercraft 10 are chines 80 that are used to deflect water from the hull 20. Each chine 80, may or may not extend the entire length of the watercraft 10.

On the bottom side of the watercraft 10 is a water intake 120 (FIG. 5) into which water is drawn from under the hull 20 by a pump 210 driven by an engine 220. The water passes through the pump 210 to a y-fitting 130 before exiting the hull 20.

The gas engine 220 is housed in a motor housing 270 and at least one battery 230 is housed in a battery housing 440 inside of the watercraft.

Within the hull 20 is at least one seat 260 located adjacent a throttle 150 that is used to control the speed of the jet pump 210.

Also situated at the bow 90 of the watercraft 10 is at least one fuel tank 290 having a vent line 300 that extends to a fuel tank vent 310 located on the exterior of the hull 20. Multiple fuel tanks 290 may also be used. A fuel tank cap 380 is removable allowing for the fuel tank to be filled. A fuel line 250 supplies fuel from the fuel tank 290 to the engine 220. Exhaust from the engine 220 is expelled through an exhaust line 240 that extends from the engine to the exterior of the hull 20.

The throttle 150 is connected to a tiller 140, as shown in FIGS. 3 and 4 and is disposed adjacent an instrument panel 280. The throttle 150 allows the driver control the speed of the watercraft 10, while operating the jet pump 210 (shown in FIG. 2). The throttle 150 and tiller 140 are controlled by one hand, allowing the other hand of the driver to feel the temperature and volume of the water cooling engine via the cooling bleed line 370 (FIG. 3). The jet pump 210 provides cooling water to the engine 220. When the jet pump is operating it forces water to both the propulsion pipes 100 and to the engine 220 for cooling. It is important to monitor the flow of the cooling water so as to prevent the engine 220 from overheating caused by a stoppage of water through cooling line 370.

The tiller 140 is connected to the electric outdrive 40 that has a propeller 200 and a skeg 90 located on the exterior of the hull 20. The curved portion 60 of the hull 20 protects the propeller 200 and skeg 190 by slightly shielding them.

The skeg 190 also protects the propeller 200 and is made to a size that is sufficient enough in size to serve as a rudder for steering. The watercraft 10 is steered by rotating the electric outdrive 40 left or right. The electric outdrive 40 is rotated by moving the tiller 140. The electric outdrive 40 can be used to steer the watercraft 10 either when the jet pump 210 is being operated or when it is not. For example, when maneuvering the watercraft 10 in situations that may require tight turns in a forward or reverse direction or even in neutral, the jet pump 210 can be turned off and the watercraft 10 powered by and steered by the electric outdrive 40.

The hull 20 may also house other items such as a rope caddy 390 (FIG. 2) and running lights 400.

Figures 5, 6, 7, 8, 9:
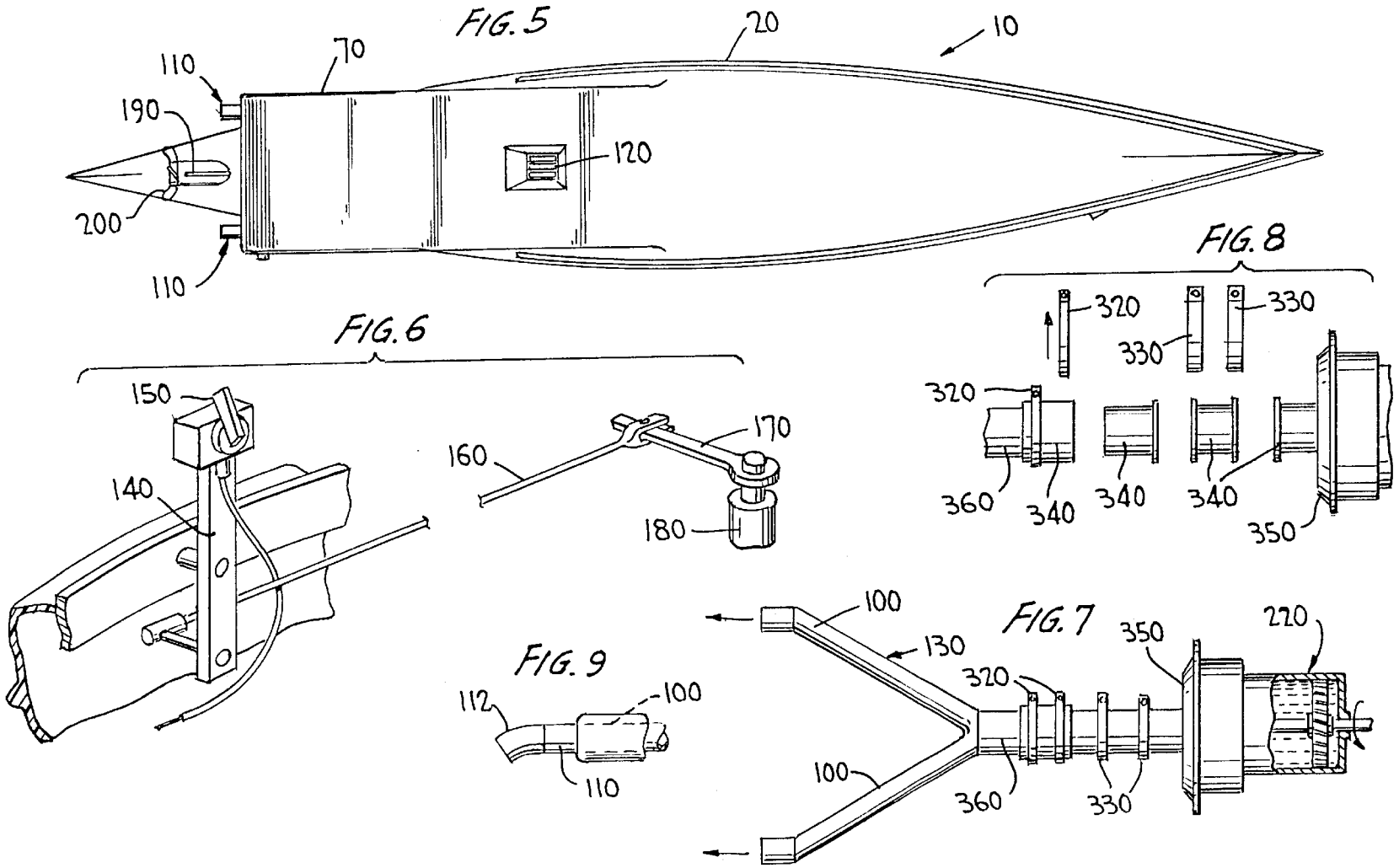
FIG. 5 is a bottom plan view of the watercraft of the present invention.
FIG. 6 is an exploded perspective view of the throttle and tiller of the electric outdrive mechanism of the watercraft of the present invention.
FIG. 7 is a top plan view of the pump end of the jet propulsion mechanism of the watercraft of the present invention.
FIG. 8 is an exploded side elevational view of the pump end of the jet propulsion mechanism of the watercraft of the present invention.
FIG. 9 is a view similar to FIG. 3 of a trim pipe option for the exit ports.

FIG. 5 shows that the wings 70 are located on either side of the hull 20 and may actually be formed as one continuous section below the bottom of the watercraft 10. The wings 70 house the propulsion pipes 100 (FIG. 2) of the jet propulsion system. At the end of each propulsion pipe 100 is an exit port 110 that allows the water that is previously drawn up through the water intake 120 (FIG. 1) to be expelled from the watercraft 10. The wings also provide protection to the skeg 190 and propeller 200 by shielding them from debris and such that may be in the water.

As shown in FIG. 6, the tiller 140 is connected to the motor shaft 180 through a plurality of steering arms 160, 170 which in turn are connected to the electric motor 410, propeller 200 and skeg 190 (FIG. 3). The electric motor 410 output shaft rotation is controlled by the forward-neutral-reverse switch 420 (FIG. 3). The electric motor speed control 430 (FIG. 3) controls the revolutions per minute (rpm) of electric motor 410. The rpm can be varied from as little as 0 rpm to top speed by rotating the dial. This combination allows the driver to control the tiller 140 which in turn controls the direction of the thrust created by the outdrive 40, with one hand while throttling the speed control 430 and operating the forward-neutral-reverse switch 420 with the other hand.

The watercraft 10 can also be steered with the jet propulsion from the jet pump 210 which is shown in greater detail in FIGS. 7 and 8. The jet propulsion is primarily comprised of a jet pump 210, main propulsion pipe 30, y-fitting 130 and propulsion pipes 100 which are connected to one another with a plurality of pipe clamps 330, hose clamps 320 and a single hose 360. The unique split-track shape of the y-fitting 130 forces water to be expelled from the propulsion system through two propulsion pipes 100. Each propulsion pipe 100 is located an equal distance from the center line of the hull 20, one on either side thereof. By limiting the flow of water through the pipes 100, the watercraft 10 could be steered. That is, by limiting the flow through the left pipe 100 will cause the vessel to turn left and by limiting the flow of water through the right pipe 100, the vessel will turn right.

The tracking of the jet propulsion system is equal to that of a system having two drives while really only having one. The tracking is improved by delivering thrust to two points outside the center line with only one drive or engine being used.

The watercraft 10 can be equipped with a plurality of batteries 230 (FIG. 2). A fuel tank 290 is situated in the bow 90, however, if multiple fuel tanks 290 are desired, they may be alternatively located in one of the battery compartments within the middle of the watercraft 10. The benefits of multiple fuel tanks are that they provide an increase in the range the boat is able to travel, due to the increase in the amount of fuel available, and also they allow the boat to be trimmed when going from one person in the stern to two people, one in the bow and one in the stern. When only one person is in the stem 50, it is more efficient to have the fuel tank in the bow 90 to be full which helps to hold down the bow when the vessel is under jet power. When two people are aboard, it is desirable to operate with very little or no fuel in the fuel tank 190 in the bow 90 so as to eliminate the extra weight. Too much weight in the front of the watercraft 10 can cause the bow 90 to become too deep in the water and not provide as smooth a ride through waves as would be achieved with a higher bow 90.

The watercraft 10 has a hull that combines some elements of a canoe with those of a power boat. The watercraft 10 has a jet pump 210 and an electric outdrive mechanism 40, both for providing power and steering capabilities to said watercraft 10.

Water is drawn from beneath the watercraft 10, through a water intake 120 into a pump 210 which pumps the water out through propulsion pipes 100 located in wings 70 formed in the hull 20. At least one battery 230 and at least one fuel tank 290 supply fuel to an engine 220 which operates said pump 210. If the water in one propulsion pipe 100 is limited, it will cause the watercraft 10 to turn in the direction of the limited water supply, thus allowing the water propulsion to steer watercraft 10.

The electric outdrive mechanism 40 has a vertical motor shaft 180, located within the watercraft 10, that is connected to a motor 410 that supplies power to the propeller 200 causing it to turn. The motor 410 has skeg 190 attached thereto for steering the watercraft 10. The motor 410, propeller 200 and skeg 190 are all located on the exterior, stem portion of the hull 20.

When under jet power a user sits within the cockpit 24 of the hull 20, they control the speed and direction of the watercraft 10 with a throttle 150 and tiller 140.

Because the weight of people and gear carried in this craft will vary it may be desirable to provide a method of trimming the cruising angle of the hull when operating the under jet power. Trim Pipes 112 (see FIG. 9) can be made in a selection of different downward angles depending on what is needed to achieve the desired cruising trim of the craft. These pipes may be made so they easily attach (in any normal manner) to the exit port 110 if needed. It is also possible to eliminate the external exit port 110 and attach the trim pipe directly to the propulsion pipe 100.

Although particular embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A watercraft, comprising:

a hull having a cockpit and opposing ends, one said end being located on the bow side and the other said end being located on the stern side of said cockpit, each said end being graduated from the width of said cockpit to a width smaller than said width of said cockpit;

a pair of wings located on a lower, exterior portion of said hull;

a jet drive for powering the watercraft and having a water intake, power source, a pump and a plurality of propulsion pipes, each of the wings having one of the propulsion pipes mounted therein upon pivotal movement of the rudder about an upright axis; and an electric outdrive for selectively powering the watercraft, the outdrive being mounted for pivotal movement about an upright axis, a rudder attached to the outdrive, a throttle operatively connected to the outdrive for controlling the speed thereof, and a tiller connected to the outdrive via steering arms to thereby provide for manual control of the direction of the watercraft upon pivotal movement of the rudder about the upright axis.

2. The watercraft of claim 1, wherein:

said jet drive further comprises a y-fitting with two ends parallel to each other and equally spaced from a centerline of said hull and a third end opposite said parallel ends;

each parallel end of said y-fitting being connected to one of said plurality of propulsion pipes, wherein said jet drive draws water from the exterior of the watercraft, through said water intake into said pump, said pump expels water through said y-fitting and out through said plurality of propulsion pipes in said wings providing power to said watercraft.

3. The watercraft of claim 2, wherein:

said electric outdrive further comprises a motor and a propeller attached thereto.

4. The watercraft of claim 1, wherein:

said jet drive further comprises a y-fitting with two propulsion pipes located thereon, an exit port located on an end of each of said propulsion pipes, said exit port being the last point of contact for water within said propulsion pipes before exiting said watercraft;

said electric outdrive comprising, a motor and a propeller;

said pair of wings located at the stern end of said hull, each wing located an equal distance from a centerline and on the opposite side of said centerline from the other wing, wherein said wings provide stability and flotation to said watercraft and house said propulsion pipes.

5. The watercraft of claim 4, wherein:

said hull has a curved portion that divides the bottom of said hull into two separate regions, with one region having a shorter depth than the other region;

said propeller, motor and rudder of said electric outdrive being located aft said curved portion of said hull, wherein said curved portion of said hull provides protection to said propeller, motor and rudder by shielding said propeller, motor and rudder from debris that may be present in the water.

6. The watercraft of claim 1, wherein:

said hull has a curved portion located at the stern which provides protection to said propeller and said rudder.

* * * * *